United States Patent [19]

Mercatoris et al.

[11] Patent Number: 4,464,055

[45] Date of Patent: Aug. 7, 1984

[54] APPARATUS FOR THE PRODUCTION OF COLLOIDAL MIXTURES

[75] Inventors: Robert Mercatoris, Eich; Fernand Artois; Joseph Colling, both of Luxembourg; Albert Feitler, Kopstal, all of Luxembourg

[73] Assignee: MecanARBED s.a.r.l., Luxembourg, Luxembourg

[21] Appl. No.: 269,825

[22] Filed: Jun. 2, 1981

[30] Foreign Application Priority Data

Jun. 4, 1980 [LU] Luxembourg ..... 82500
Dec. 8, 1980 [LU] Luxembourg ..... 82988

[51] Int. Cl.[3] ..... B28C 5/00; B28C 5/26; B28C 7/00

[52] U.S. Cl. ..... 366/26; 366/40; 366/65; 366/168; 366/194; 366/197

[58] Field of Search ..... 366/2, 3, 10, 13, 16, 366/26, 40, 41, 42–46, 64–67, 97–99, 168, 200, 185, 201, 192, 193, 194–196, 197–199, 206–208, 244–251, 282, 325, 329, 349, 605

[56] References Cited

U.S. PATENT DOCUMENTS

| | | | |
|---|---|---|---|
| 2,269,736 | 1/1942 | Rogers | 366/247 X |
| 2,684,273 | 7/1954 | Fears et al. | 366/343 X |
| 3,151,847 | 10/1964 | Broomall | 366/287 X |
| 3,520,519 | 7/1970 | Cross | 366/250 |
| 4,257,710 | 3/1981 | Delcoigne et al. | 366/40 X |

*Primary Examiner*—Timothy F. Simone
*Attorney, Agent, or Firm*—Michael J. Striker

[57] ABSTRACT

A method for producing colloidal mixtures, especially water-cement mixtures with or without further solid additions, comprising the steps of feeding the material for forming the colloidal mixture into a container, stirring the material fed into the container by a blade stirrer driven by a motor at a circumferential speed at the outer diameter of the blade stirrer of at least 500 and preferably 1,500 meters per minute, continuously measuring the variations in the energy take-up of the motor, and stopping stirring of the material when the continuously observed energy take-up indicates a sudden transition from a fluctuating to a substantially steady course; and an apparatus for carrying out this method.

11 Claims, 3 Drawing Figures

FIG. 2
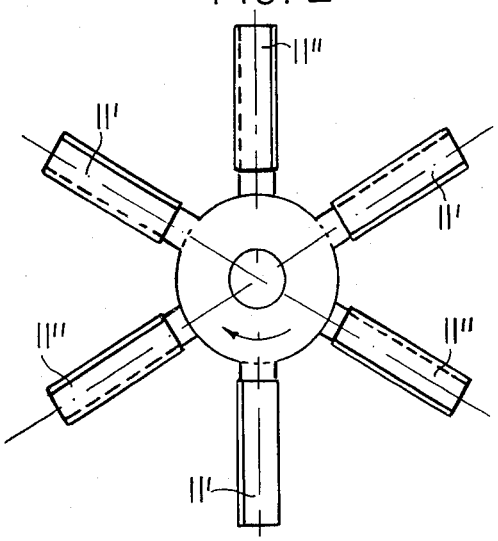
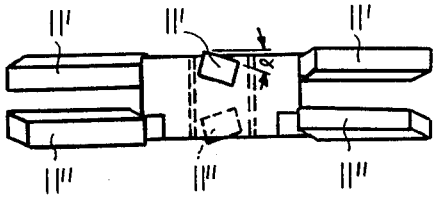
FIG. 3

APPARATUS FOR THE PRODUCTION OF COLLOIDAL MIXTURES

BACKGROUND OF THE INVENTION

The present invention relates to an apparatus for the production of colloidal mixtures, especially castable respectively sprayable colloidal water-cement mixtures, which may contain additional solid additions. The present invention relates also to a method for producing such colloidal mixtures.

The production of colloidal water-cement mixtures for producing of the colloidal concrete requires specific mixing apparatus. Such mixtures are produced in that energy is introduced into the extensively mixed components. Due to the introduced energy the individual cement particles are extensively wetted and it is possible to transform the mixture into colloidal condition, that is into a condition in which neither liquid water nor solid cement particles are present but an extensively blended homogeneous mixture, which exists in a single phase.

The introduction of energy into an initially present two-phase system, consisting of water and therein suspended solid cement, is of course best carried out by a suitable stirrer.

The DE-OS No. 27 18 236 describes a method in which cement and water at a ratio of 0.25:0.6 is premixed in a mixer during a time period of about 2 minutes with a circumferential speed of the mixture of about 300 meters per minute and subsequently thereto subjected for at least 8 minutes to a mass acceleration of at least 2 g ($g=9.81$ meters/sec$^2$).

A further method is described in the Luxembourg Pat. No. 81,524, assigned to the same assignee, in which water in the amount of 25–60% of the final mixture is rotated in a container by means of a stirrer having at its outer diameter a circumferential speed of at least 1,500 meters per minute, in which cement is then introduced into the mixture while maintaining the rotational speed of the stirrer or by reducing the speed to at most the half of the mentioned circumferential speed, and wherein subsequently thereto sand in the amount of 2 parts for each cement part with a moisture content of 5–15% is introduced into the mixture in such a manner that the sand is fed into the center of the funnel-shaped profile formed in the mixture by the stirring.

It has been ascertained that the addition of sand causes, surprisingly, that cements of lesser quality, even though they can be well colloided but which produced quite often mixtures without sufficient adhesion characteristics, may be used in accordance with this method, which evidently results in considerable advantages as to production costs and supply of raw material.

Such colloidal water cement mixtures with or without further solids addition serves especially for the coating of cast steel parts, such as conduits, boilers, containers, and the like. Such mixtures are especially used to replace expensive corrosion-preventing films, lacquers or plastic coating in a cost-saving manner. A main advantage of such colloidal mixtures consists in that the steel parts which have to be coated do not require a surface treatment, for instance by sand blasting, which increases the cost of conventional corrosion protection to a considerable degree.

It has, however, been ascertained that even small deviations from the individual method charateristics above described, as for instance a too high or too low moisture content of the sand or a inexact introduction of the sand, lead to a failure of the above described production process.

Thus, if the sand is not correctly introduced into the mixture in the manner as described above, the mixture may rise along the inner surface of the mixture and settle there, while a cavity forms around the blades of the mixer in which the blades rotate without producing any action.

Furthermore, the mixing time should not be surpassed in order to avoid a premature settling of the mixture, while at the same time it is necessary to carry out the mixing and stirring as long and as intensively as possible since this is a necessary precondition for proper colloiding.

SUMMARY OF THE INVENTION

It is an object of the present invention to provide an apparatus for the production of colloidal mixtures, which avoids the disadvantages of such apparatus and methods known in the art.

With these and other objects in view, which will become apparent as the description proceeds, the apparatus according to the present invention for the production of colloidal mixtures, especially water-cement mixtures with or without further solid additions, mainly comprising a mixing container, an inlet for the solid material to be fed into the container, a blade stirrer arranged adjacent the bottom of the container, drive means arranged above the container, shaft means connecting said drive means with the stirrer, a protective casing surrounding a portion of the shaft means in the container and having a lower end tightly engaging the shaft means and connected to the latter for rotation therewith, in which the casing projects upwardly from the lower end radially spaced from the shaft means and has an upper open end, and water inlet means arranged for discharging a stream of water in the region of the upper open end of the casing into the container. The container can preferably be lifted and lowered between an upper and a lower position and in the upper position of the container the ratio between the diameter of the blade stirrer and the diameter of the container in the middle plane of the blades of the stirrer is preferably 1:1.5 to 1:2.

The idea on which the present invention is based rests on the observation that the best results with respect to the quality of the produced colloidal mixtures are obtained when the material to be mixed assumes during its mixing and stirring in the container the form of a stationary wave of a profile substantially in the form of a lemniscate. At such a form the material particles are subjected to an acceleration which leads to a substantial disintegration thereof, which is necessary for the production of the colloidal mixture.

The acceleration of the particles can be produced by corresponding high stirring speeds, whereby however it has to be taken into consideration that a surpassing of a certain upper speed limit, which depends on the condition of the material, on the configuration of the mixing container and on the construction of the stirrer, especially the blades thereof, will cause the mixture to rise at the inner surface of the container and settle there, whereas a cavity will form about the blades of the stirrer in which the blades will rotate without producing any action.

If one starts from the premise that conventional stirrers with inclined blades will cause a certain acceleration of the particles, then it is logical according to the present invention not to surpass a certain upper speed limit, but to produce increased acceleration by providing a plurality of accelerators, the individual actions of which are cumulative.

For this reason the stirrer of the apparatus according to the present invention comprises a plurality of radially extending angularly spaced blades of equal dimensions arranged in at least one plane normal to the axis of the stirrer shaft, and wherein each blade is inclined in a direction opposite the direction of the rotation at an angle of about 12° with respect to the plane. Preferably the blades of the stirrer are arranged in series in at least two plane extending normal to the axis of the stirrer shaft and spaced a distance corresponding at least to the thickness of a blade in the longitudinal direction of the shafts from each other, whereby the blades of one series are angularly displaced through equal angles from the adjacent blades of the other series. Each series may comprise three blades, and in this case the blades of one series include an angle of 60° with the adjacent blades of the other series.

Whereas by use of a stirrer in which all blades are arranged in one plane, the acceleration effect is solely a function of the rotational speed of the stirrer and the inclination of the blades, a stirrer in which the blades are arranged in two vertically spaced planes has the advantage that to the acceleration from zero to a first value a further acceleration is added, which starts already from a relatively high value.

The protective casing surrounding the stirrer shaft serves to protect the stirrer from fouling by settled colloidal mixture rests.

Indeed it is sufficient when according to the present invention the water is directed in a stream into the upper open end of the protective casing so that the stirrer is freed from impurities. After the production of a colloidal mixture is finished, the container is lowered and the contents are discharged, whereafter the container is again raised, the stirrer set into operation, and the water for the next charge is introduced in the manner as described. Since the protective casing is connected at its lower end to the stirrer shaft for rotation therewith, a centrifugal effect is produced which contributes to maintain the shaft in clean condition. The apparatus according to the present invention has the further advantage that the moment at which a proper colloidal mixture is obtained and after which a further stirring does not contribute to increase of the quality of the product, but increases only the danger of settling or bonding thereof, can be exactly determined. In fact, to determine this moment it is only necessary to observe the energy take-up of the drive for the stirrer.

According to the present invention the stirrer is rotated at a circumferential speed at the outer diameter thereof with at least 500 but preferably 1500 meters per minute. It has been ascertained that prior to obtaining a colloidal condition, that is during the presence of a solid and a liquid phase in the mixture, the energy take-up of the electric drive motor is irregular, whereby the variations can be observed in an ampere meter, especially if the latter is provided with a continuous recording apparatus. Variations in the energy take-up of the motor abruptly end at a definite moment, that is at a moment in which the mixture in the container is completely colloided. At this moment it is advisable to stop any further stirring.

The novel features which are considered characteristic for the invention are set forth in particular in the appended claims. The invention itself, however, both as to its construction and its method of operation, together with additional objects and advantages thereof, will be best understood from the following description of preferred embodiments when read in connection with the accompanying drawing.

BRIEF DESCRIPTION OF THE DRAWING

FIG. 2 is a top view of the actual stirrer of the apparatus; and

FIG. 3 is a side view of the stirrer.

DESCRIPTION OF THE PREFERRED EMBODIMENT

Figure 1:
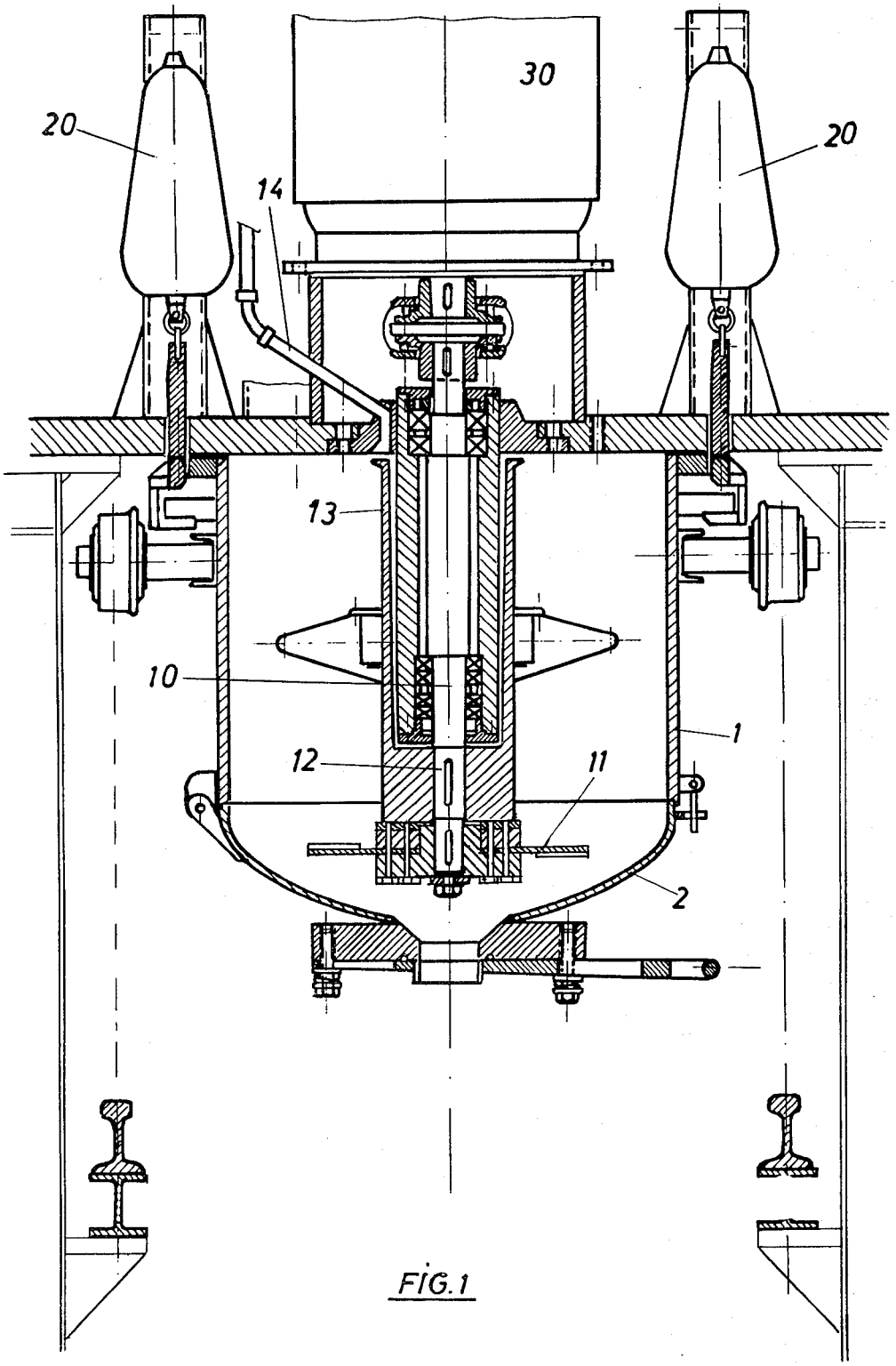
FIG. 1 schematically illustrates a partly sectioned side view of an apparatus for the production of colloidal mixtures in accordance with the present invention.

The apparatus according to the present invention illustrated in FIG. 1 comprises a container 1 of a substantially cylindrical configuration having a concavely curved bottom portion 2 hingably connected at 3 to the upper portion of the container and held in the position shown in FIG. 1 by a latch 4. The container 1 is raisable and lowerable by means of suitable lifting and lowering apparatus 20 of known construction which are mounted on a support 21 and which are preferably releasably connected to the container 1. A pair of axles 5 are connected in any suitable manner to an upper portion of the container 1 and project normal to the vertical axis of the container therefrom and carry at their outer ends a pair of rollers 6 aligned in vertical direction with a pair of rails 22 so that container 1, when lowered, may be transported on the rails 22 and its contents be discharged through the central discharge opening 7 at the bottom portion 2 of the container, which discharge opening 7 is openable and closable by a slide valve 8 of known construction. The stirring apparatus 10 comprises a shaft 12 to the lower end of which a blade stirrer with a plurality of radially extending blades 11, of which only are two are shown in FIG. 1, is connected for rotation with the shaft 12. The shaft 12 is turnably supported in the region of its upper end by ball bearings 14 and above its lower end by similar ball bearings 14 mounted in a tubular support 15 connected at its upper end to the support 21. A protective casing 13 surrounds with clearance the tubular support 15 and engages between the lower end of the tubular support and the upper surface of the blade stirrer the shaft 12 and being connected thereto for rotation therewith. The upper end of the protective casing 13 is open. The shaft 12 is rotated by an electromotor 30 mounted on the support 21 in the manner as shown in FIG. 1, and the motor 30 has an output shaft 31 coaxial with the shaft 12 and preferably connected thereto by a fluid coupling 32 of known construction to reduce the starting drive moment of the motor. The electric motor 30 is connected by conductor 33 to the network, and in one of the conductors 33 an ampere meter 34 is arranged so that the variation in the energy take-up of the electric motor 30 during operation of the apparatus may be continuously observed. The necessary water for producing the water-cement mixture is introduced into the container 1 through a conduit 14 which directs a stream of water onto the region of the upper open end of the protective casing to thus prevent at the same time accumulation of residual material around the shaft 12. The cement and any further solid additions are introduced into the container 1 through inlet means 9, schematically shown in FIG. 1.

While FIG. 1 illustrates a stirrer in which the blades 11 are all located in a plane, FIGS. 2 and 3 show a preferred construction in which the blades of the stirrer are arranged in two planes which are vertically spaced from each other through a distance at least equal to the thickness of a blade. As shown in FIGS. 2 and 3 a first series of three blades 11' are arranged in an upper plane normal to the axis of the shaft 12, and these three blades 11' project in radial direction from the axis of the shaft 12 displaced through 120° from each other. The second series of three blades 11'', arranged in the lower plane, are likewise circumferentially displaced through 120° from each other and circumferentially displaced through 60° with regard to the blades 11. The blades are preferably inclined at an angle $\alpha$ in direction opposite to the direction of rotation of the blade as indicated by the arrow shown in FIG. 2, and this angle $\alpha$ is preferably about 12°.

The above described apparatus will be operated in the following manner:

Water and cement are fed into the container 1 in the required proportions, and the material thus fed into the container 1 is stirred by the blade stirrer which is rotated by the motor 30 at a circumferential speed at the outer ends of the blades 11 of at least 500 but preferably 1,500 meters per minute. The variation of the energy take-up of the motor is continuously observed on the ampere meter 34 and such observation may be facilitated by providing the ampere meter 34 with a recording apparatus of known construction indicating these variations in a zigzag line. The stirring is stopped when the continuously observed energy take-up of the motor 30 indicates a sudden transition from a fluctuating to a substantially steady course. Subsequently thereto, the container 1 is lowered until the rollers 6 engage the rails 22 and then the container is transported away from the stirring apparatus to a place of use, at which the colloidal mixture in the container is discharged through the outlet opening 7.

The apparatus and method according to the present invention have considerable advantages over such apparatus and methods known in the art.

In the first place, it is possible to produce colloidal mixtures while reducing the stirring speed usually critical for conventional apparatus without any risk. This will result in savings for producing the apparatus according to the present invention, especially as far as the rated power of the motor is concerned, which drives the stirring device.

Furthermore, it is possible to reduce the usual stirring speed far below the critical speed and to drastically reduce simultaneously thereto also the duration of the colloiding process. This will assure that at an optimal quality of the final product the risk of a premature setting of the material is eliminated.

It will be understood that each of the elements described above, or two or more together, may also find a useful application in other types of apparatus for producing of colloidal mixtures differing from the types described above.

While the invention has been illustrated and described as embodied in an apparatus for producing colloidal mixtures, especially water-cement mixtures with or without further solid additions, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. Apparatus for the production of colloidal mixtures, especially water-cement mixtures comprising a mixing container having a bottom; an inlet for the solid material to be fed into said container; a blade stirrer arranged adjacent to the bottom of the container; drive means arranged above the mixing container; shaft means having a portion in said container and connecting said drive means with said blade stirrer; a protective casing surrounding the portion of the shaft means in said container and having a lower end tightly engaging said shaft means and connected to the latter for rotation therewith, said casing projecting upwardly from said lower end radially spaced from said shaft means and having an upper open end; and water inlet means arranged for discharging a stream of water in the region of said upper open end of said casing into said container so as not only to supply water for producing a water-cement mixture, but also to prevent accumulation of residual material on said shaft means.

2. Appartus as defined in claim 1, and including support means supporting said drive means above said contiainer and means mounted on said support means for lifting and lowering said container between an upper and a lower position.

3. Apparatus as defined in claim 2, wherein the blades have a middle plane, in said upper position of said container the ratio between the outer diameter of the blade stirrer and the inner diameter of the container in the middle plane of the blades of the stirrer being 1:1.5 to 1:2.

4. Apparatus as defined in claim 3, wherein said stirrer comprises a plurality of radially extending angularly displaced blades of equal dimensions arranged in at least one plane normal to the axis of said shaft means and wherein each blade is inclined in a direction opposite to the direction of their rotation at an angle of about 12° with respect to said plane.

5. Apparatus as defined in claim 3, wherein said stirrer comprises a plurality of angularly displaced blades of equal dimensions arranged in series in at least two planes extending normal to the axis of the shaft means and spaced at predetermined relatively short distance in the longitudinal direction of said axis from each other, the blades of one series being angularly displaced through equal angles from the adjacent blades of the other series and each of said blades being inclined at an angle of about 12° with respect to the respective plane in which they are arranged.

6. Apparatus as defined in claim 5, wherein each series of blades has three blades, and wherein the blades of each series are displaced through 120° from each other and through an angle of 60° with respect to the blades of the other series.

7. Apparatus as defined in claim 6, wherein said predetermined distance corresponds at least to the thickness of a blade.

8. Apparatus as defined in claim 1, wherein said drive means is an electromotor having an output shaft, said shaft means comprising said output shaft and a shaft coaxial therewith and carrying at a lower end portion said blade stirrer, and a fluid coupling connecting said output shaft with said coaxial shaft for reducing the starting moment between said motor and said stirrer.

9. Apparatus as defined in claim 1, wherein said drive means is an electric motor and including a measuring instrument in circuit with the electromotor for continuously indicating variations in the energy take-up of the motor.

10. Apparatus as defined in claim 2, wherein said support means comprises a pair of parallel rails located below the bottom of the container in said upper position of the latter and extending transverse to the axis of the shaft means, and including a pair of rollers connected to opposite outer surface portions of the container rotatable about aligned axes normal to that of the shaft and respectively aligned in vertical direction with the pair of rollers.

11. Apparatus as defined in claim 1, and including a central outlet opening in the bottom of the container and slide valve means for opening and closing said outlet opening.

* * * * *